United States Patent [19]

Pastva, Jr.

[11] 4,320,642

[45] Mar. 23, 1982

[54] PADDLE LOCKS WITH HANDLE DISCONNECT FEATURES

[75] Inventor: John V. Pastva, Jr., Parma Hts., Ohio

[73] Assignee: The Eastern Company, Cleveland, Ohio

[21] Appl. No.: 108,007

[22] Filed: Dec. 28, 1979

[51] Int. Cl.[3] ..... E05B 55/04; E05C 1/14

[52] U.S. Cl. ..... 70/472; 70/149; 70/204; 70/218; 70/489; 292/173; 292/226; 292/DIG. 27; 292/DIG. 31

[58] Field of Search ..... 70/472, 488, 489, 149, 70/204, 218, 221–224, 416; 292/167, 173, 223, 226, DIG. 27, DIG. 31, DIG. 37

[56] References Cited

U.S. PATENT DOCUMENTS

| | | | |
|---|---|---|---|
| 5,492 | 3/1848 | Pye | 292/DIG. 27 X |
| 95,507 | 10/1869 | Petre | 292/DIG. 27 X |
| 269,953 | 1/1883 | Moritz . | |
| 528,450 | 10/1894 | Swanberg . | |
| 1,751,184 | 3/1930 | Wodarra . | |
| 1,785,381 | 12/1930 | Holtzman . | |
| 1,840,062 | 1/1932 | Taylor . | |
| 1,909,210 | 5/1933 | Miller . | |
| 1,911,564 | 5/1933 | Gahagan . | |
| 1,960,410 | 5/1933 | Christensen . | |
| 1,964,066 | 6/1934 | Kuszmaul . | |
| 2,053,805 | 9/1936 | Van Note . | |
| 2,075,948 | 4/1937 | Kuszmaul . | |
| 2,117,715 | 5/1938 | Godfried . | |
| 2,274,455 | 2/1942 | Murphy . | |
| 2,322,892 | 6/1943 | Springer . | |
| 2,453,505 | 11/1948 | Fornwald . | |
| 2,459,029 | 1/1949 | Ingres et al. . | |
| 2,468,644 | 4/1949 | Springer . | |
| 2,582,928 | 1/1952 | Dall . | |
| 2,603,963 | 7/1952 | Allen . | |
| 2,629,618 | 2/1953 | Roethel . | |
| 2,649,321 | 8/1953 | Smith . | |
| 2,658,781 | 11/1953 | Allen . | |
| 2,700,290 | 1/1955 | Dall . | |
| 2,705,882 | 4/1955 | Craig . | |
| 2,705,884 | 4/1955 | Craig . | |
| 2,723,145 | 11/1955 | Smith . | |
| 2,728,214 | 12/1955 | Craig . | |
| 2,759,351 | 8/1956 | Allen | 70/149 X |
| 2,772,908 | 12/1956 | Craig . | |
| 2,773,716 | 12/1956 | Craig . | |
| 2,782,062 | 2/1957 | Smith . | |
| 2,877,043 | 3/1959 | Leslie . | |
| 2,955,864 | 10/1960 | Van Voorhees . | |
| 2,978,895 | 4/1961 | Heisler . | |
| 2,987,907 | 6/1961 | Cockburn et al. . | |
| 3,007,731 | 11/1961 | Roethel . | |
| 3,069,889 | 12/1962 | Johnstone et al. . | |
| 3,104,124 | 9/1963 | Beck . | |
| 3,121,580 | 2/1964 | Di Salvo et al. . | |
| 3,129,026 | 4/1964 | Gergoe et al. . | |
| 3,153,551 | 10/1964 | Sandor et al. . | |
| 3,171,677 | 3/1965 | Klove, Jr. et al. . | |
| 3,309,127 | 3/1967 | Pickles . | |
| 3,314,708 | 4/1967 | Welch . | |
| 3,386,760 | 6/1968 | Bessette . | |
| 3,394,957 | 7/1968 | Foley . | |
| 3,423,117 | 1/1969 | Klove, Jr. et al. . | |
| 3,587,259 | 6/1971 | Sandor . | |
| 3,649,061 | 3/1972 | Meyer . | |
| 3,672,713 | 6/1972 | Pickles . | |
| 3,679,251 | 7/1972 | Brockman et al. . | |
| 3,695,660 | 10/1972 | Fetters . | |
| 3,695,663 | 10/1972 | Cockburn . | |
| 3,697,105 | 10/1972 | Marx . | |
| 4,073,170 | 2/1978 | Miyabayashi et al. | 292/DIG. 37 X |
| 4,116,027 | 9/1978 | Tannery . | |
| 4,170,119 | 10/1979 | Kalis, Jr. . | |

FOREIGN PATENT DOCUMENTS

| | | | |
|---|---|---|---|
| 135399 | 9/1947 | Australia . | |
| 717308 | 2/1942 | Fed. Rep. of Germany . | |
| 232079 | 4/1925 | United Kingdom | 292/DIG. 27 |

OTHER PUBLICATIONS

Brochure describing a complex Atwood lock.

*Primary Examiner*—William E. Lyddane
*Attorney, Agent, or Firm*—Burge & Porter Co.

[57] ABSTRACT

A door lock has a flush-mountable body. A forwardly facing recess is defined by the body. A paddle-type handle is pivotally carried by the body and is movable between a nested position within the body recess and an operating position. A bolt is carried on the back of the body and is movable between latching and unlatching positions. A key-controlled disconnect linkage is provided for selectively connecting and disconnecting the handle and the bolt. The disconnect linkage includes a disconnect member which is moved by a key-operated locking member between connecting and disconnecting positions located, respectively, in and out of the path of travel of a handle operating arm. When the disconnect linkage drivingly connects the handle and the bolt, movement of the handle from its nested position to an operating position will cause corresponding unlatching movement of the bolt. When the disconnect linkage disconnects the handle from the bolt, movement of the handle is inoperative to cause unlatching movement of the bolt. A feature of the disconnect linkage is that it provides the lock with a "slam" capability, meaning that the bolt can be slammed into latching engagement with a suitable configured strike regardless of whether the disconnect linkage is drivingly connecting or disconnecting the handle and the bolt. Three exemplary lock embodiments are described.

13 Claims, 24 Drawing Figures

PADDLE LOCKS WITH HANDLE DISCONNECT FEATURES

CROSS-REFERENCE TO RELATED APPLICATIONS

PADDLE LOCK WITH PIVOTALLY MOUNTED HANDLE DISCONNECT MEMBER, Ser. No. 108,010 filed concurrently herewith on Dec. 28, 1979 by Albert L. Pelcin, hereinafter "Disconnect Case II."

PADDLE LOCK WITH BOLT-CARRIED HANDLE DISCONNECT MEMBER, Ser. No. 107,859 filed concurrently herewith on Dec. 28, 1979 by John V. Pastva, Jr. and Albert L. Pelcin, hereinafter "Disconnect Case III."

PADDLE LOCK WITH ROTATABLY-MOUNTED HANDLE DISCONNECT MEMBER, Ser. No. 108,017 filed concurrently herewith on Dec. 28, 1979 by James A. Reed and Edwin W. Davis, hereinafter "Disconnect Case IV."

PADDLE LOCK WITH TRANSLATABLY-MOUNTED HANDLE DISCONNECT MEMBER, Ser. No. 108,015 filed concurrently herewith on Dec. 28, 1979 by Edwin W. Davis, hereinafter "Disconnect Case V."

PADDLE LOCK WITH HANDLE DISCONNECT, Ser. No. 108,016 filed concurrently herewith on Dec. 28, 1979 by Jye P. Swan, John V. Pastva, Jr. and Donald J. Dignan, hereinafter "Disconnect Case VI."

PADDLE LOCK WITH GUARD-PROTECTED HANDLE DISCONNECT MEMBER, Ser. No. 107,858 filed concurrently herewith on Dec. 28, 1979 by Edwin W. Davis, hereinafter "Disconnect Case VII."

FLUSH-MOUNTABLE LOCK WITH ACTUATOR DISCONNECT FEATURE, Ser. No. 108,011 filed concurrently herewith on Dec. 28, 1979 by Edwin W. Davis, hereinafter "Disconnect Case VIII."

The present application and the applications cross-referenced above have been assigned to a common entity, The Eastern Company, a corporation of Connecticut.

BACKGROUND OF THE INVENTION

1. Field of the Invention

The present invention relates generally to a door lock having a latch bolt which is movable between latching and unlatching positions, a handle for unlatching the bolt, and a key control for selectively permitting and preventing the handle from unlatching the bolt. More particularly, the invention relates to a lock of this type including a key-controlled disconnect linkage for selectively drivingly connecting and disconnecting the handle and the bolt, whereby the handle is, at all times, freely movable between normal and operating positions, but is functional only when the key control is "unlocked" to enable the handle to unlatch the bolt.

While the present invention has particularly advantageous use in conjunction with flush-type door locks used on swinging doors of vehicles, industrial cabinets, electrical equipment enclosures and the like, principles of the invention are not limited in application to such uses.

2. Prior Art

Flush-type door locks including a body, a lock bolt movably carried on the body, and an operating handle for moving the bolt relative to the body are well known. Normally the handle is in a flush or nested position when the bolt is latched. Bolt unlatching is effected by moving the handle to an operating position. Locks of this type are well suited for use on swinging doors of vehicles such as trucks, on merchandise, tool and equipment cabinets, electrical equipment enclosures and the like.

Flush-type, paddle-handle door locks employing key-operated rotatable cams for selectively permitting and preventing unlocking movements of operating handles, and having spring-projected slide bolts, are described in U.S. Pat. Nos. 3,707,862, and 3,668,907 granted Jan. 2, 1973 and June 13, 1972, respectively, to John V. Pastva, Jr. An ornamental appearance employed in locks of this general type is illustrated in U.S. Pat. No. De. 230,132 issued Jan. 29, 1974 to John V. Pastva, Jr.

The provision of a handle disconnect feature in a door lock is desirable in that the presence of such a feature will lessen, if not totally eliminate, incidents of these locks being damaged by would-be intruders. Since the handles of most previously proposed door locks are restrained from moving when the locks are locked, it is common for would-be intruders to attempt to gain entry by applying excessive leverage force to the lock handles. Where handle disconnect features are provided, the lock handles may always be moved freely, but are functional to retract the lock bolts only when the locks are "unlocked." Locks having handle disconnect features can be made practically entryproof short of the application of such forces as will totally destroy the locks.

Door locks employing various types of handle disconnect systems have been proposed. Prior proposals have, however, suffered from a variety of drawbacks including complexities of construction and failures to mount all of the operating parts of a lock on a single body member so that the resulting locks form compact, easy to install units.

3. The Cross-Referenced Disconnect Cases

The present invention and the inventions described in the several referenced Disconnect Cases represent the work products of a continuous and continuing development program which began nearly a decade ago.

The several handle disconnect systems described in the referenced Disconnect Cases were developed by coworkers operating, in some instances independently, and in other instances jointly, as is reflected in the naming of sole and joint inventors. Many of the disconnect system features claimed in separate ones of the referenced Disconnect Cases were developed substantially concurrently.

Where a claim in one of the referenced Disconnect Cases is found to be generic to a development concept utilized in another of these cases, it should be understood that care has been taken to present the generic claim in the case which describes the earliest development of a species that will support the generic claim. In this manner, a careful effort has been made to establish clear lines of demarcation among the claimed subjects matter of this and the several referenced Disconnect Cases. No two of these cases include claims of identical scope.

SUMMARY OF THE INVENTION

The present invention overcomes the foregoing and other drawbacks of the prior proposals by providing several embodiments of novel and improved, reliable and durable, handle-operated door locks capable of providing relatively maintenance-free service. Simple but sturdy key-controlled disconnect linkages are provided for selectively drivingly connecting and disconnecting the handles and latch bolts of the locks.

A door lock embodying principles of the present invention preferably includes a support structure or body having front and back wall surfaces. A latch bolt is movably supported on the body at a location behind the back wall. The bolt is movable between latching and unlatching positions with respect to the body. A handle is supported on the body for movement between normal and operating positions.

A key-controlled disconnect linkage has a locking member which is movable between locked and unlocked positions. A disconnect member is moved by the locking member between connecting and disconnecting positions wherein the disconnect member selectively drivingly connects and disconnects the handle and the latch bolt. When the locking member is in its locked position, the disconnect member disconnects the handle and the bolt such that movement of the handle will cause no corresponding movement of the bolt. When the locking member is in its unlocked position, the disconnect member is operable to drivingly connect the handle and the bolt such that, when the handle is moved out of its normal position to an operating position, the bolt is unlatched.

A further feature of locks embodying the preferred practice of the present invention is that they have "slam" capabilities, meaning that their latch bolts may be slammed into latching engagement with suitably configured strikes regardless of whether the locking members of the locks are "locked" or "unlocked."

The disconnect linkage includes several improvements over previously proposed handle disconnect systems. The disconnect member is mounted on the back of the lock body and is therefore shielded by the lock body from access by would-be intruders. The disconnect member is mounted for movement between connecting and disconnecting positions located, respectively, in and out of the path of travel of a handle operating arm. When the disconnect member is in its connecting position, it is positioned in the path of travel of the handle operating arm to provide a driving connection between the handle and the latch bolt. When the disconnect member is in its disconnecting position, it is positioned out of the path of travel of the handle operating arm and provides no driving connection between the handle and the latch bolt.

As will be apparent from the foregoing summary, a feature of the present invention lies in the provision of a novel and improved door lock with a key-controlled disconnect system for selectively drivingly connecting and disconnecting an operating handle and a latch bolt.

These and other features and a fuller understanding of the present invention may be had by referring to the following detailed description and claims taken in conjunction with the accompanying drawings.

DESCRIPTION OF THE PREFERRED EMBODIMENTS

1. The Embodiment of FIGS. 1–7

Figure 1:
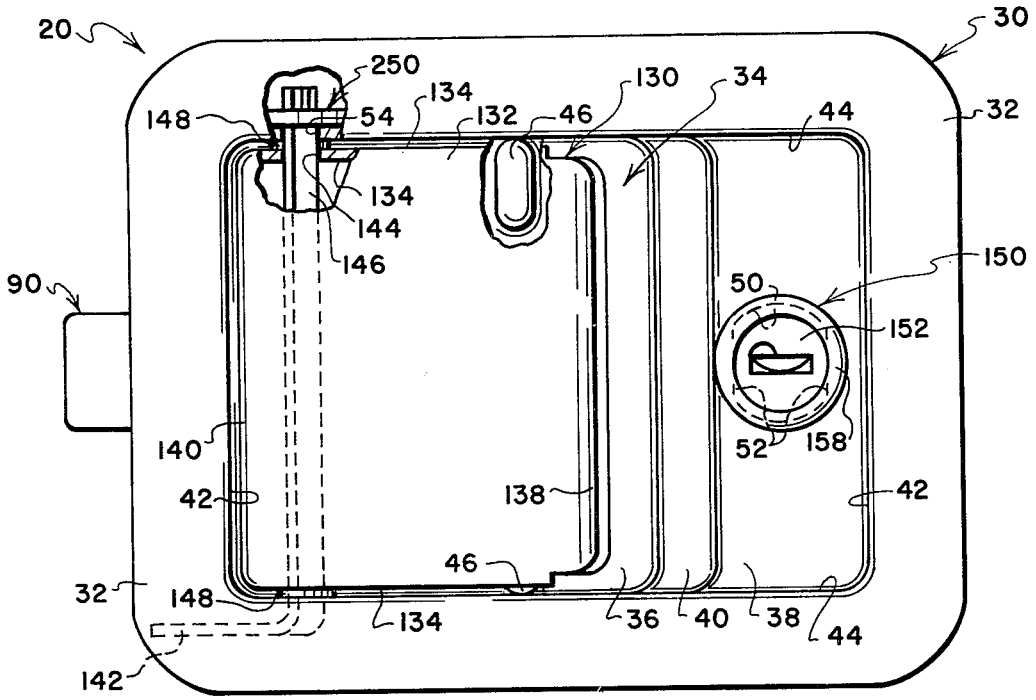
FIG. 1 is a front side elevational view of a first lock embodiment incorporating features of the present invention with portions broken away to permit underlying components to be viewed, with the components of the lock being positioned in an unlocked attitude, with the handle nested and the bolt projected.

Referring to FIGS. 1–7, one embodiment of a key-controlled, paddle-handle, flush-mountable lock including features of the present invention is indicated generally by the numeral 20. The lock 20 is adapted to be supported on such structures as a swinging door (not shown) for relative movement therewith to bring the lock 20 into and out of juxtaposition with a suitably configured conventional strike (not shown) supported on a door frame or other structure (not shown). The manner in which locks of this general type are mounted on doors is well known to those skilled in the art. The mounting of such locks is described and illustrated in such patents as Pastva, Jr., U.S. Pat. No. 3,668,907.

In general, the lock 20 includes a recessed body 30 having a bolt housing 60 welded to the rear side of the body 30. The bolt housing 60 and the back wall of the body 30 cooperate to define an elongate passage 70. A bolt 90 is slidably carried in the passage 70 for movement between retracted and projected positions. A compression coil spring 110 biases the bolt 90 toward its projected position. A paddle handle 130 is pivotally carried on the body 30 for movement between nested and operating positions. A key control 150, a disconnect member 180, and a control lever 182 are provided for selectively drivingly connecting and disconnecting the handle 130 and the bolt 90. A handle return spring 250 biases the handle 130 toward its normal nested position.

The body 30 is a rectangular, pan-shaped metal stamping having a perimetrically extending flange 32 which surrounds a forwardly facing recess 34. Left and right back wall portions 36, 38 define levels of different depths in opposite end portions of the recess 34. An inclined back wall portion 40 interconnects the left and right back wall portions 36, 38. Forwardly extending end walls 42 and side walls 44 connect the back wall portions 36, 38, 40 with the flange 32.

Other features of the body 30 include a pair of stops 46 formed in the left back wall portion 36. The stops 46 project into the recess 34 at locations near the side walls 44, and are engaged by the handle 130 when the handle 130 is in its nested position. A hole 50 is formed through the right back wall portion 38. Opposite sides of the hole 50 have flat, parallel-extending surfaces 52. Aligned holes 54 are formed through the side walls 44 near their left ends, as viewed in FIG. 1.

The bolt housing 60 is a channel-shaped sheet metal stamping having a pair of inclined side walls 64 which cooperate with the back wall portion 36 to define a bolt mounting passage 70 of substantially triangular cross-section. The housing 60 has an end wall 66. Four mounting flanges 68 are formed at the corners of the housing 60. The flanges 68 overlie and are welded to the rear side of the left back wall portion 36. The end wall 66 is formed as an integral part of one of the side walls 64 and operates to close a majority of the area of the right end of the bolt passage 70. A locking tab 72 is formed integrally with the other of the side walls 64 and is folded to overlie the end wall 66 to reinforce the end wall 66.

Figure 3:
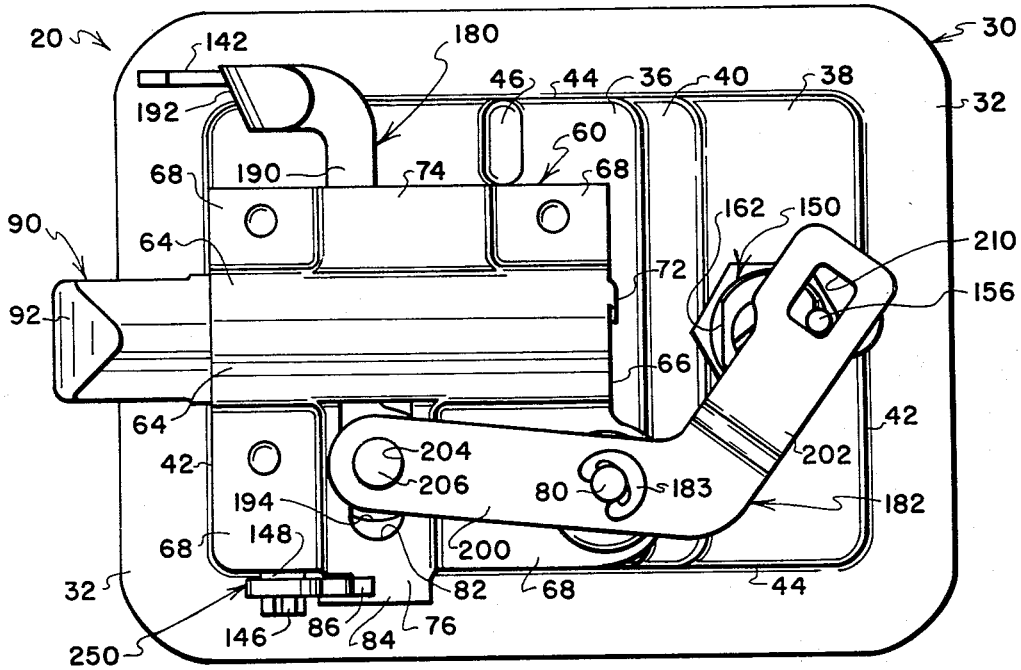
FIG. 3 is a rear side elevational view of the lock of FIG. 1 with the components of the lock positioned as shown in FIG. 1.

The bolt housing 60 additionally includes a pair of wall portions 74, 76 which cooperate with the back wall portion 36 to define a passage 78 through which the disconnect member 180 extends. The passages 70, 78 intersect at a location overlying the bolt 90. A mounting formation in the form of a pin 80 is welded to one of the mounting flanges 68 for pivotally supporting the control lever 182. As is best seen in FIG. 3, a laterally extending slot 82 is formed in the wall portion 76 at a location overlying the passage 78. The wall portion 76 extends slightly beyond one of the side walls 44, as is indicated by the numeral 84. A slot 86 is provided in the extended portion 84 to receive one end of the handle return spring 250.

Figure 4:
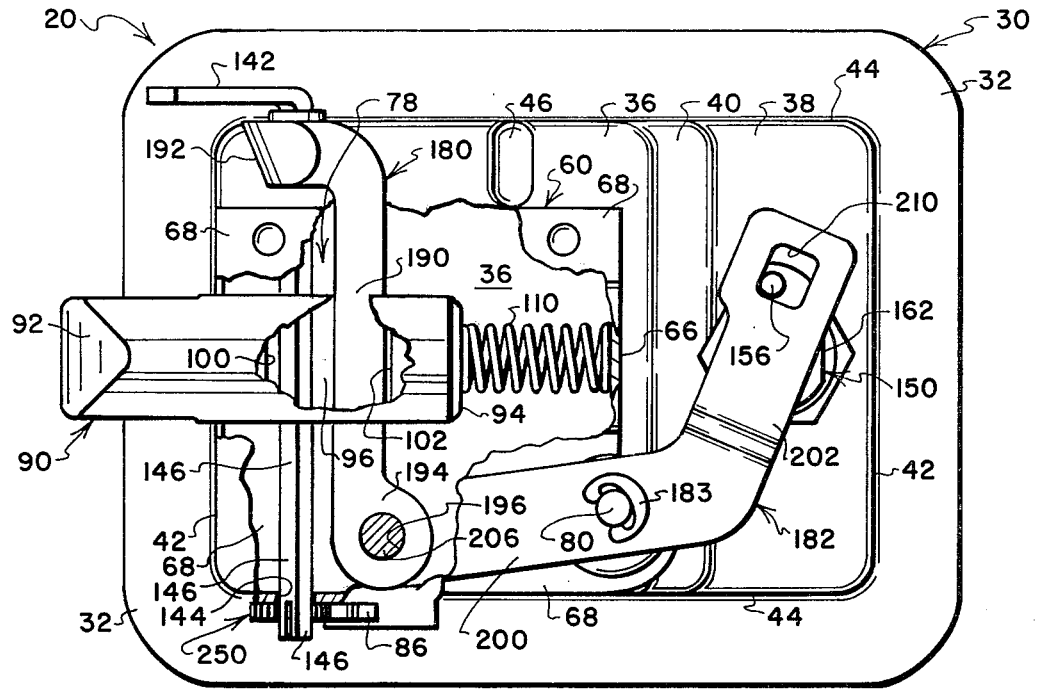
FIG. 4 is a rear side elevational view similar to FIG. 3 with portions of the lock broken away to permit underlying components to be viewed, with the components of the lock being positioned in a locked attitude, with the handle nested and the bolt projected.
Figure 6:
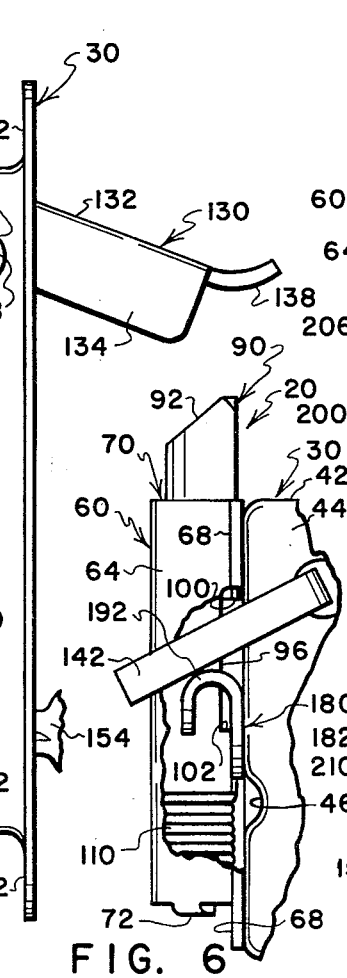
FIG. 6 is a bottom plan view similar to FIG. 5 with portions broken away to permit underlying components to be viewed, the components of the lock being positioned as shown in FIG. 5.

The bolt 90 is a solid metal member which can be formed by conventional casting or powder metallurgy techniques. The bolt 90 has a generally triangular cross section which corresponds to that of the passage 70. The bolt 90 has a tapered left end 92 configured, as is conventional, to permit the bolt 90 to be retracted in response to slamming engagement with a suitable configured strike (not shown). The bolt 90 has a flat right end 94, as seen in FIG. 4. The bolt 90 has a receiving formation which preferably takes the form of a laterally extending slot 96, as best seen in FIG. 6. The bolt slot 96 aligns with the passage 78 and has end walls 100, 102 at its opposite ends. The disconnect member 180 extends through the slot 96.

Figure 5:
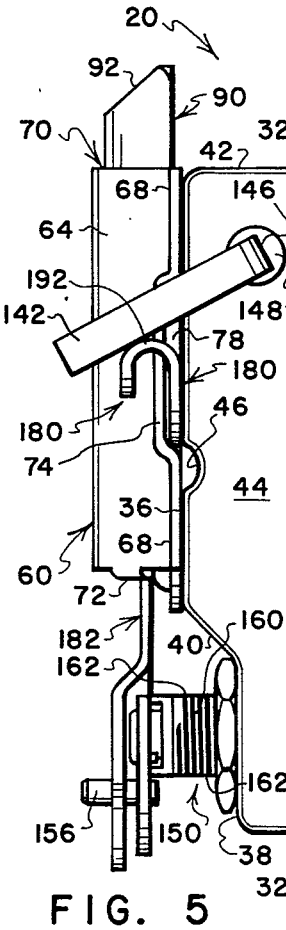
FIG. 5 is a bottom plan view similar to FIG. 2 with the components of the lock being positioned in an unlocked attitude, with the handle extended to an operating position and the bolt retracted.

The bolt 90 is movable between a projected or latching position, shown in FIGS. 1–4, and 7, and a retracted or unlatching position shown in FIGS. 5 and 6. When the bolt 90 is projected, its tapered left end 92 extends beyond the left edge of the body flange 32. When the bolt 90 is retracted, its tapered left end 92 extends substantially evenly with the left edge of the body flange 32.

The compression coil spring 110 is positioned in the passage 70. The spring 110 has a left end which engages the bolt end 94, and a right end which engages the bolt housing end wall 66. The spring 110 biases the bolt 90 leftwardly, as viewed in FIGS. 1–4, toward its projected position, and is compressed to progressively greater degrees as the bolt 90 is retracted.

The paddle handle 130 is a sheet metal stamping having a generally rectangular, substantially flat plate portion 132 and a pair of opposed, in-turned side flanges 134. An outwardly turned gripping flange 138 is provided at the right end of the handle 130, and a slightly inwardly turned flange 140 is provided at the left end.

The handle 130 has aligned mounting holes 144 of square configuration formed through its side flanges 134. A shaft 146 of substantially square cross section extends through the body holes 54 and drivingly engages the handle mounting holes 144, whereby the handle 130 is pivotally mounted on the body 30 at a location between the body side walls 44. A pair of plastic ferrules 148 journal the shaft 146 in the body holes 54. The shaft 146 is drivingly connected to the handle 130 for rotary movement as the handle 130 pivots about the axis of the shaft 146. An operating arm 142 is carried on one end of the shaft 146 at a location behind the body flange 32.

Figure 2:
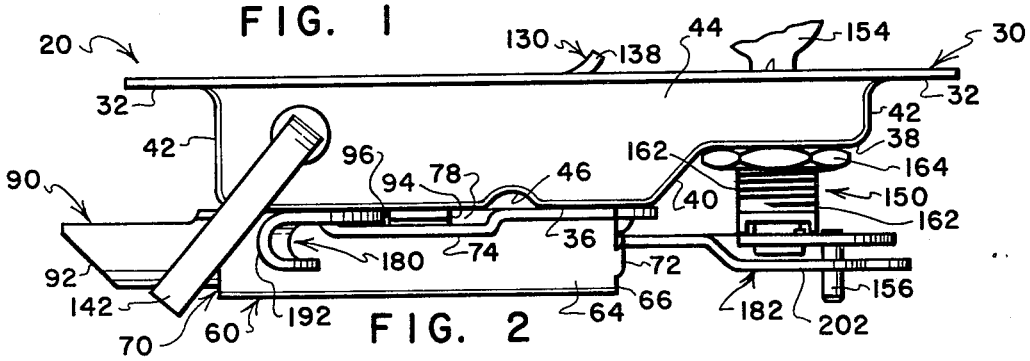
FIG. 2 is a bottom plan view of the lock of FIG. 1 with the components of the lock positioned as shown in FIG. 1.

When the handle 130 is in its normal nested position, as shown in FIGS. 1–3, the spring 110 biases the bolt 90 leftwardly. At the same time, the handle return spring 250 biases the handle 130 clockwise, as viewed in FIG. 2, toward a position where the handle side flanges 134 engage the bottom wall stops 46. The handle return spring 250 is a spiral-wrapped torsion coil spring which has an inner end connected to one end of the shaft 146 and an outer end retained in the bolt housing slot 86.

Figure 7:
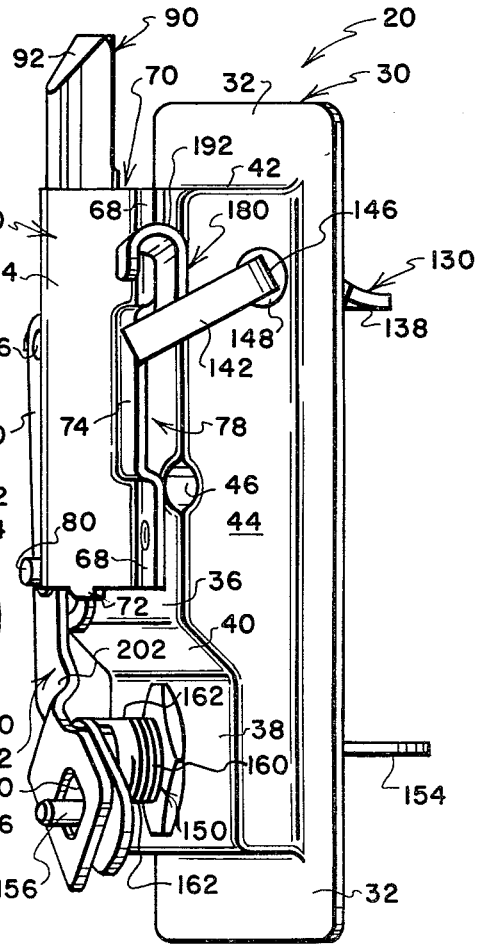
FIG. 7 is a perspective view of the lock of FIG. 1 with the components of the lock being positioned in a locked attitude, with the handle extended and the bolt nonetheless still in its projected position.

When the handle 130 is moved out of its nested position to an operating position by pivoting it counterclockwise about the axis of the shaft 146, as viewed in FIGS. 5 and 7, the bolt 90 will be retracted in opposition to the action of the spring 110 only if the disconnect member 180 is positioned in what will be termed its "connecting" position. In FIGS. 2, 3, 5 and 6, the disconnect member 180 is in its connecting position wherein it provides a driving connection between the handle 130 and the bolt 90. When the disconnect member 180 is in its connecting position, the bolt 90 is caused to retract into the passage 70 as the handle 130 pivots out of its nested position, as is shown in FIGS. 5 and 6. In FIGS. 4 and 7, the disconnect member 180 is in its "disconnecting" position. When the disconnect member 180 is in its disconnecting position, it provides no driving connection between the handle 130 and the bolt 90 whereby, when the handle 130 is pivoted about the axis of the shaft 146, no corresponding retraction movement of the bolt 90 takes place.

As is seen in FIG. 4, the disconnect member 180 is normally spaced from the left end surface 100 of the slot 96. The spacing between the slot end surface 100 and the disconnect member 180 provides a lost motion connection which permits the bolt 90 to be retracted with respect to the passage 70, without requiring corresponding pivotal movement of the handle 130. This feature is desirable because it provides the lock 20 with a capability to be "slammed" to bring the bolt 90 into latching engagement with a suitably configured strike (not shown) without causing the handle 130 to pivot out of its nested position.

The key control 150 includes a lock cylinder 152 into which a key 154 may be inserted. The key 154 is configured to cooperate with tumblers housed within the cylinder 152 to permit a locking member 156 to be rotated between locked and unlocked positions. The unlocked position of the locking member 156 is shown in FIGS. 2, 3, 5 and 6. The locked position of the locking member 156 is shown in FIGS. 4 and 7.

The cylinder 152 is provided with an enlarged head 158 and a threaded body 160. A pair of flats 162 are formed on opposite sides of the threaded body 160. The cylinder 152 is positioned with its head 158 engaging the forward surface of the right body portion 38, with its body 160 extending through the hole 50, and with its flats 162 engaging the flat surfaces 52. A locknut 164 is threaded onto the body 160 to hold the cylinder 152 in place on the lock body 30.

While the key control 150 is of a conventional, commercially available type, it is selected from among various commercially available key controls which have particular operational characteristics. These operational characteristics should include key removal capability when the locking member 156 is positioned in either of its locked and unlocked positions. A further characteristic of the key control 150 is that, once the locking member 156 has been positioned in either of its locked or unlocked positions and the key 154 has been removed from the cylinder 152, the key control 150 maintains the locking member 156 in such position.

Referring to FIG. 4, the disconnect member 180 has an elongate, flat central section 190. A rounded abutment surface 192 is defined near one end of the central section 190. An enlarged disc-like formation 194 is provided at the other end of the central section 190. A hole 196 is formed through the disc-like formation 194.

Referring to FIG. 3, the control lever 182 is pivotally mounted on the bolt housing pin 80. An E-shaped retaining clip 183 holds the control lever 182 in place on the pin 80. The lever 182 is of substantially L-shape having first and second legs 200, 202. The first leg 200 overlies the bolt housing slot 82 at a location above the disc-like formation 194 of the disconnect member 180. A hole 204 is formed in the first leg 200. A pin 206 extends through the disconnect member hole 196, through the bolt housing slot 82 and into the control lever hole 204 to pivotally interconnect the disconnect member 180 and the control lever 182. The pin 206 has a diameter which slip fits within the bolt housing slot 82 as the control lever pivots about the axis of the bolt housing pin 80.

The second leg 202 extends toward and overlies the key control 150. A slot 210 is formed in the second leg 202. The locking member 156 extends into the slot 210.

When the locking member 156 is in its unlocked position, as shown in FIGS. 2 and 3, the locking member 156 positions the control lever 182 to shift the disconnect member 180 laterally with respect to the bolt passage 70 to a connecting position where, as is best seen in FIGS. 2 and 3, the abutment surface 192 is positioned within the path of travel of the handle operating arm 142 to provide a driving connection between the handle 130 and the bolt 90. When the disconnect member 180 is in its connecting position, pivotal movement of the handle 130 from its nested position, shown in FIG. 2, to an operating position, shown in FIG. 5, will cause the disconnect member 180 to move downwardly, as viewed in FIGS. 5 and 6, carrying with it the bolt 90. Stated in another way, when the locking member 156 is in its unlocked position as shown in FIGS. 2 and 3, the disconnect member 180 is positioned such that it engages the bolt slot end 102 whereby a driving connection is established between the handle 130 and the bolt 90. Under these circumstances, movement of the handle 130 to its operating position will cause corresponding retracting movement of the bolt 90, as is illustrated in FIGS. 5 and 6.

When the locking member 156 is in its locked position, as shown in FIGS. 4 and 7, the disconnect member 180 is shifted laterally with respect to the bolt passage 70 to a position where, as is best seen in FIG. 4, the abutment surface 192 is positioned out of the path of travel of the operating arm 142. When the disconnect member 180 is in its disconnecting position, pivotal movement of the handle 130 from its nested position to its operating position will cause no movement of the disconnect member 180, nor will it cause movement of the bolt 90. Stated in another way, when the locking member 156 is in its locked position as shown in FIG. 4, the disconnect member 180 is positioned such that no driving connection is established between the handle 130 and the bolt 90. Under these circumstances, the handle 130 may be moved freely without causing any corresponding retraction movement of the bolt 90, as is illustrated in FIG. 7.

Referring to FIG. 4, the normal extended position of the bolt projection spring 110 is shown. Referring to FIG. 6, when the handle 130 is extended with the lock 20 "unlocked," the bolt projection spring 110 is compressed. When, on the other hand, the handle 130 is extended with the lock 20 "locked," the bolt 90 remains in its projected position, and the spring 110 remains in its extended attitude.

2. The Embodiment of FIGS. 8–13

Referring to FIGS. 8–13, a second embodiment of a key-controlled, paddle-handle, flush-mountable lock including features of the present invention is indicated generally by the numeral 320. The lock 320 is adapted to be supported on such structures as a swinging door (not shown) for relative movement therewith to bring the lock 320 into and out of juxtaposition with a suitably configured strike (not shown) supported on a door frame or other structure (not shown). The manner in which locks of this general type are mounted on doors is well known to those skilled in the art.

In general, the lock 320 includes a recessed body 330 having a bolt housing 360 welded to the rear side of the body 330. The bolt housing 360 and the back wall of the body 330 cooperate to define an elongate passage 370. A bolt 390 is slidably carried in the passage 370 for movement between retracted and projected positions. A compression coil spring 410 biases the bolt 390 toward its projected position. A paddle handle 430 is pivotally carried on the body 330 for movement between nested and operating positions. A key control 450 and a disconnect member 480 are provided for selectively drivingly connecting and disconnecting the handle 430 and the bolt 390. A handle return spring 550 biases the handle 430 toward its normal nested position.

The body 330 is a rectangular, pan-shaped metal stamping having a perimetrically extending flange 332 which surrounds a forwardly facing recess 334. Left and right back wall portions 336, 338 define different depths in opposite end portions of the recess 334. Forwardly extending end walls 342 and side walls 344 connect the back wall portion 336, with the flange 332.

Other features of the body 330 include a pair of stops 346 formed in the back wall 336. The stops 346 project into the recess 334 at locations near the end walls 342 and are engaged by the handle 430 when the handle 430 is in its nested position. A hole 350 is formed through the mounting flange 332. Opposite sides of the hole 350 have flat, parallel-extending surfaces 352. Aligned holes 354 are formed through the end walls 342.

The bolt housing 360 is a channel-shaped sheet metal stamping having a pair of inclined side walls 364 which cooperate with the back wall portion 336 to define a bolt mounting passage 370 of substantially triangular cross-section. The housing 360 includes an end wall 366. Four mounting flanges 368 are formed at the corners of the bolt housing 360. The flanges 368 overlie and are welded to the rear side of the back wall 336. The end wall 366 is formed as an integral part of one of the side walls 364, and operates to close a majority of the area of the right end of the bolt passage 370. A locking tab 372 is formed integrally with the other of the side walls 364 and is folded to overlie the end wall 366 to reinforce the end wall 366. The bolt housing 360 additionally includes a pair of wall portions 374, 376 which cooperate with the back wall portion 336 to define a passage 378 through which the disconnect member 480 extends.

Figure 11:
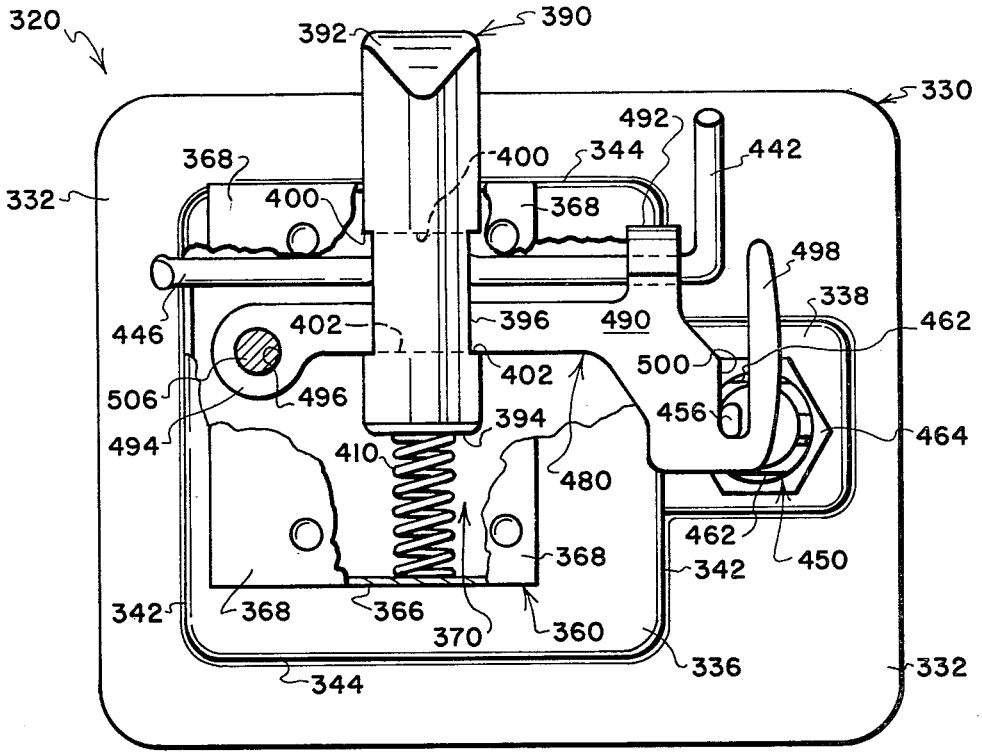
FIG. 11 is a rear side elevational view similar to FIG. 10 with portions broken away to permit underlying components to be viewed, with the components of the lock being positioned in a locked attitude, with the handle nested and the bolt projected.

The bolt 390 is a solid metal member which can be formed by conventional casting or powder metallurgy techniques. The bolt 390 has a generally triangular cross section which corresponds to that of the passage 370. The bolt 390 has a tapered end 392 configured, as is conventional, to permit the bolt 390 to be retracted in response to slamming engagement with a suitably configured strike (not shown). The bolt 390 has a flat right end 394, as is best seen in FIG. 11. The bolt 390 has a receiving formation which preferably takes the form of an elongate slot 396 provided in the central part of the bolt 390. The bolt slot 396 has end walls 400, 402 at its opposite ends.

Figure 12:
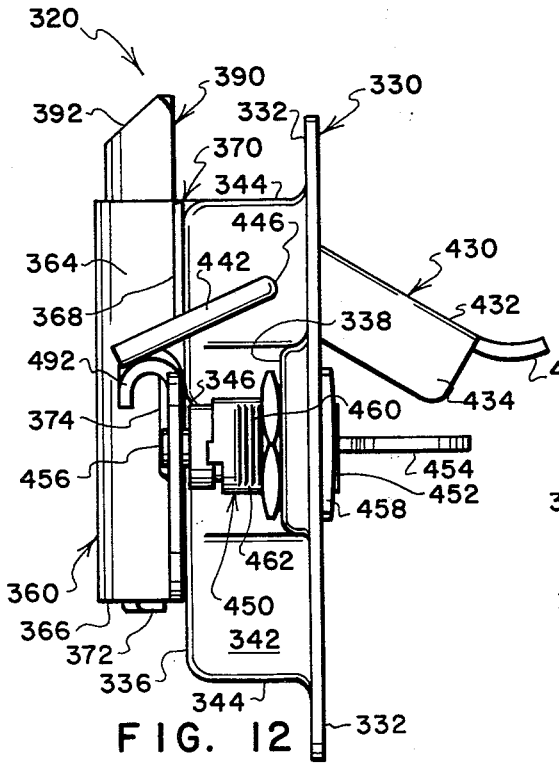
FIG. 12 is a bottom plan view of the lock of FIG. 8 with the components of the lock being positioned in an unlocked attitude, with the handle extended to an operating position and with the bolt retracted.

The bolt 390 is movable between a projected or latching position, shown in FIGS. 8–11 and 13, and a retracted or unlatching position shown in FIG. 12. When the bolt 390 is projected, its tapered end 392 extends beyond an edge of the body flange 332. When the bolt 390 is retracted, its tapered end 392 is retracted with respect to the body flange 332.

The compression coil spring 410 is positioned in the passage 370. The spring 410 has one end which engages the bolt end 394, and an opposite end which engages the bolt housing end walls 366, as is best seen in FIG. 11. The spring 410 biases the bolt 390 toward its projected position, and is compressed to progressively greater degrees as the bolt 390 is retracted.

The paddle handle 430 is a sheet metal stamping having a generally rectangular, substantially flat plate portion 432 and a pair of opposed, inwardly-turned side flanges 434. An outwardly-turned gripping flange 438 is provided at one end of the handle 430, and an inwardly-turned flange 440 is provided at the other end.

The handle 430 has aligned mounting holes 444 formed through its side flanges 434. A shaft 446 extends through the body holes 354 and through the handle mounting holes 444 to pivotally mount the handle 430 on the body 330 at a location between the body end walls 342. The shaft 446 is drivingly connected to the handle 430 for rotary movement as the handle 430 pivots. An operating arm 442 is carried on one end of the shaft 146 at a location behind the body flange 332.

Figure 8:
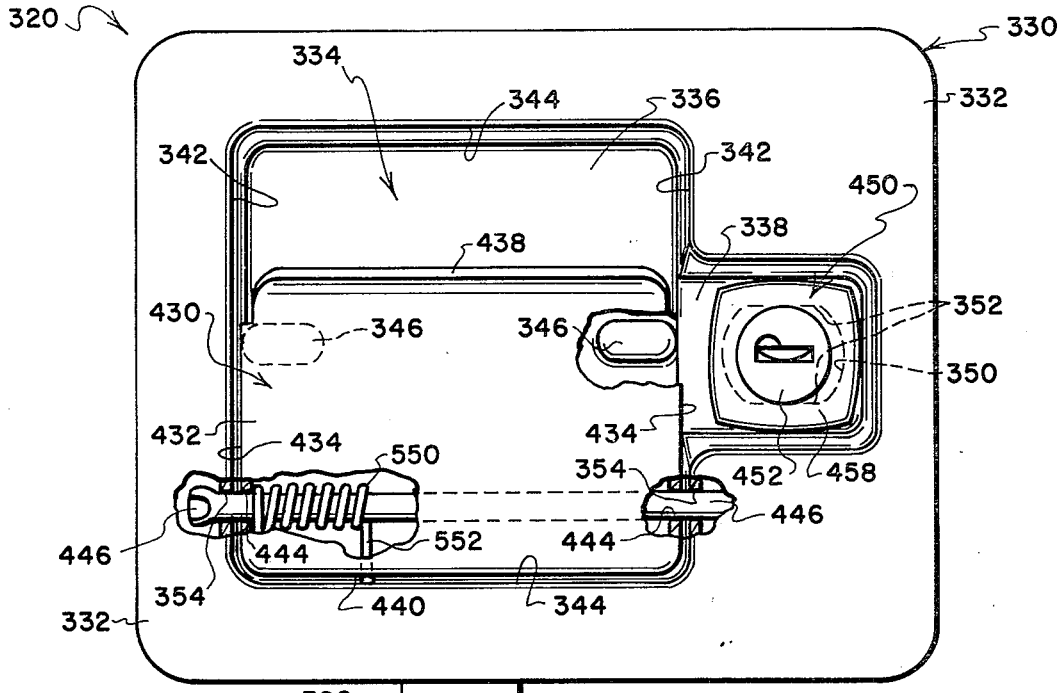
FIG. 8 is a front side elevational view of a second lock embodiment incorporating features of the present invention, the components of the lock being positioned in an unlocked attitude, with the handle nested and the bolt projected.

When the handle 430 is in its normal nested position, as shown in FIGS. 8–11, the spring 410 biases the bolt 390 toward its projected position. At the same time, the handle return spring 550 biases the handle 430 toward a nested position wherein the handle side flanges 434 engage the bottom wall stops 346. Referring to FIG. 8, the handle return spring 550 is a torsion coil spring, has its central portion reeved around the shaft 446. One end 552 of the spring 550 is connected to the handle flange 440. The other end of the spring is not shown in the drawings but extends in a conventional manner into engagement with the bottom wall portion 336.

When the handle 430 is moved out of its nested position to an operating position by pivoting it about the axis of the shaft 446, as viewed in FIG. 12, the bolt 390 will be retracted in opposition to the action of the spring 410 only if the disconnect member 480 is positioned in what will be termed its "connecting" position. In FIGS.

Figure 13:
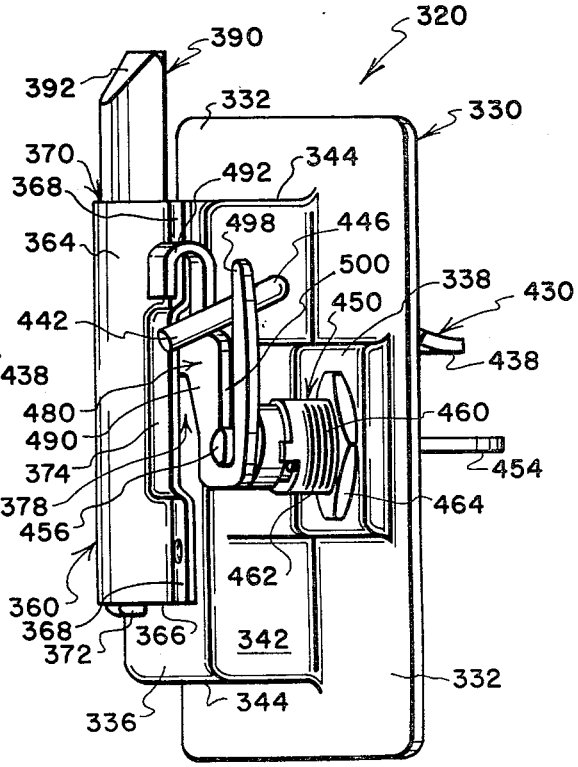
FIG. 13 is a perspective view of the lock of FIG. 8 with the components of the lock being positioned in a locked attitude, with the handle extended to an operating position and with the bolt nonetheless still in its projected position.
Figure 14:
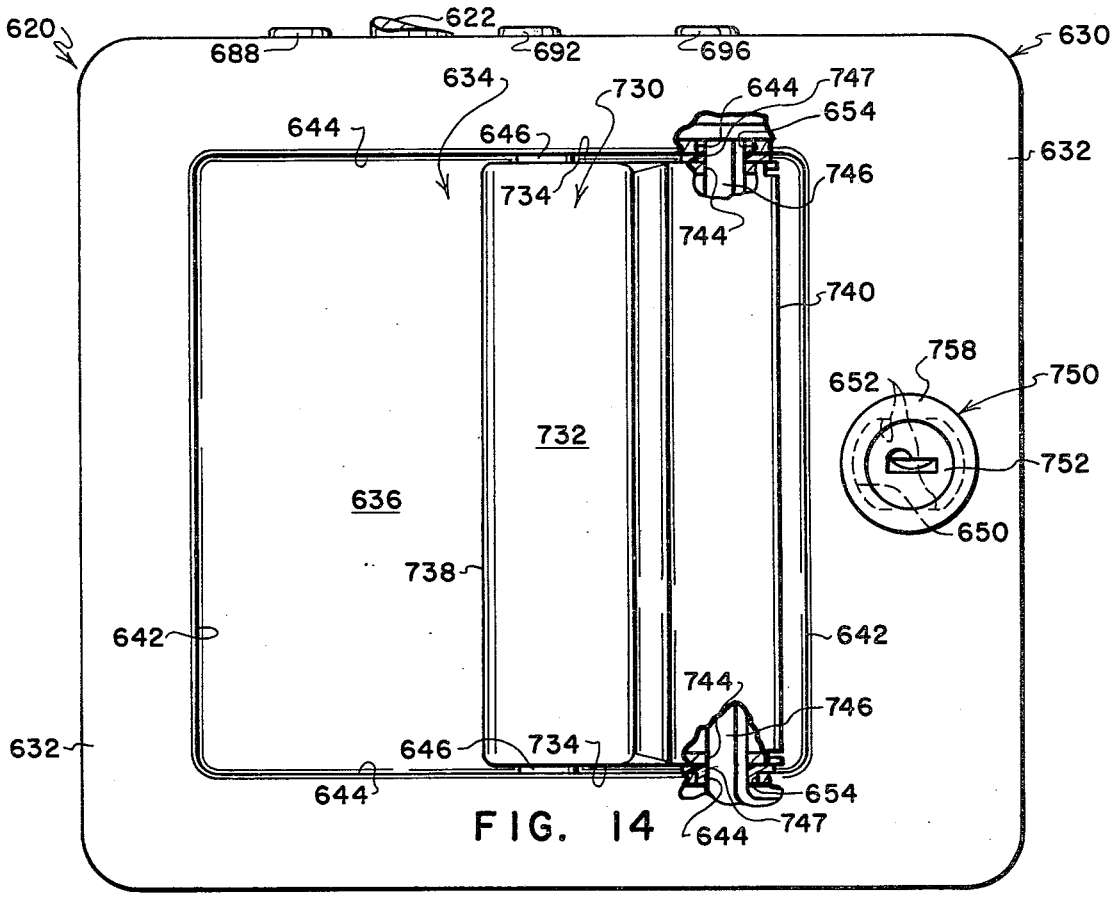
FIG. 14 is a front side elevational view of a third lock embodiment incorporating features of the present invention, the components of the lock being positioned in an unlocked attitude, with the handle nested and with the latch bolt in latching engagement with a strike.

8–10 and 12, the disconnect member 480 is in its connecting position wherein it provides a driving connection between the handle 430 and the bolt 390. When the disconnect member 480 is in its connecting position, the bolt 390 is caused to retract into the passage 370 as the handle 430 pivots out of its nested position, as is shown in FIG. 12. In FIGS. 11 and 13 the disconnect member 480 is in its "disconnecting" position. When the disconnect member 480 is in its disconnecting position, it provides no driving connection between the handle 430 and the bolt 390 whereby, when the handle 430 is pivoted about the axis of the shaft 446, no corresponding retraction movement of the bolt 390 takes place, as is illustrated in FIG. 13.

As is best seen in FIG. 11, the disconnect member 480 is normally spaced from the end surface 400 of the slot 396. The spacing between the slot end surface 400 and the disconnect member 480 provides a lost motion connection which permits the bolt 390 to be retracted with respect to the passage 370 without requiring corresponding pivotal movement of the handle 430. This feature is desirable because it provides the lock 320 with a capability to be "slammed" to bring the bolt 390 into latching engagement with a suitably configured strike (not shown) without causing the handle 430 pivot out of its nested position.

Figure 9:
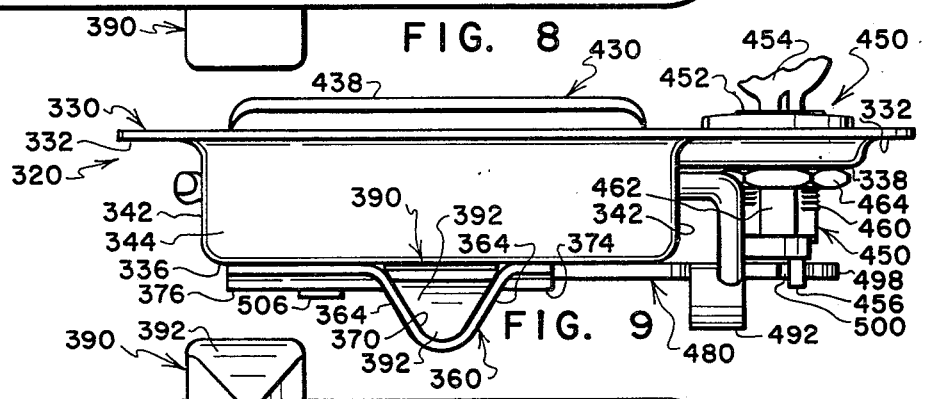
FIG. 9 is an end view of the lock of FIG. 8 with the components of the lock positioned as shown in FIG. 8.
Figure 10:
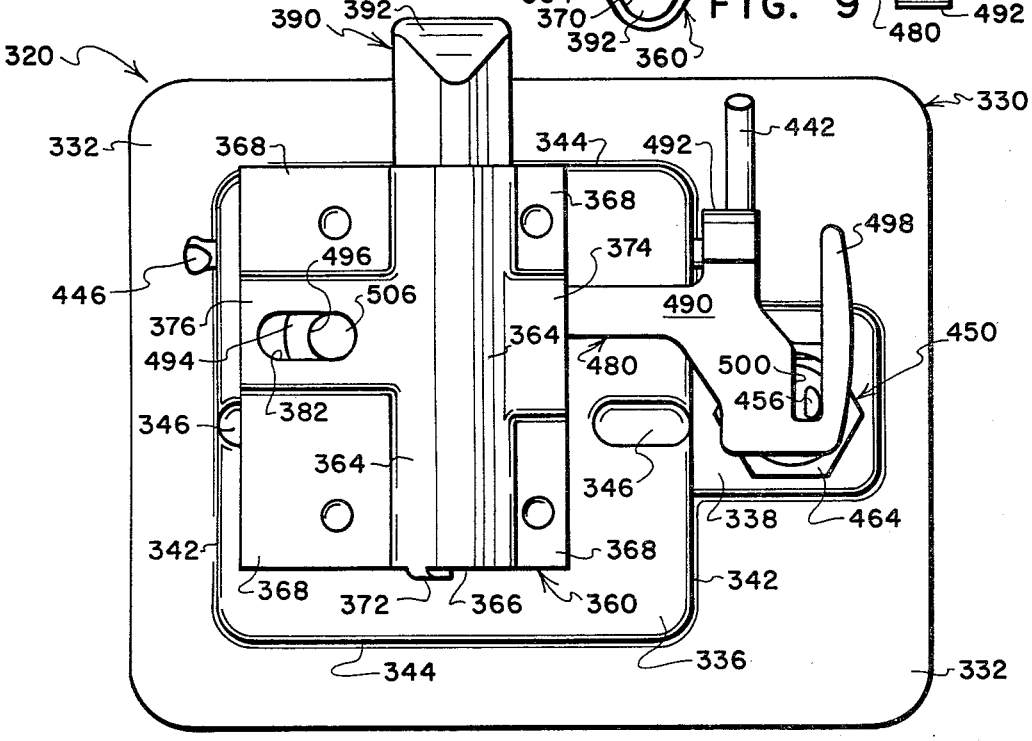
FIG. 10 is a rear side elevational view of the lock of FIG. 8 with the components of the lock being positioned as shown in FIG. 8.

The key control 450 includes a lock cylinder 452 into which a key 454 may be inserted. The key 454 is configured to cooperate with tumblers housed within the cylinder 452 to permit a locking member 456 to be rotated between locked and unlocked positions. The unlocked position of the locking member 456 is shown in FIGS. 11 and 13. The locked position of the locking member 456 is shown in FIGS. 9, 10 and 12.

The cylinder 452 is provided with an enlarged head 458 and a threaded body 460. A pair of flats 462 are formed on opposite sides of the threaded body 460. The cylinder 452 is positioned with its head 458 engaging the forward surface of the body portion 338, with its body 460 extending through the hole 350, and with its flats 462 engaging the flat surfaces 352. A locknut 464 is threaded onto the body 460 to hold the cylinder 452 in place on the lock body 330.

While the key control 450 is of a conventional, commercially available type, it is selected from among various commercially available key controls which have particular operational characteristics. These operational characteristics should include key removal capability when the locking member 456 is positioned in either of its locked and unlocked positions. A further characteristic of the key control 450 is that, once the locking member 456 has been positioned in either of its locked or unlocked positions and the key 454 has been removed from the cylinder 452, the key control 150 maintains the locking member 456 in such position.

Referring to FIG. 11, the disconnect member 480 has an elongate, flat central section 490. A rounded abutment surface 492 is provided on the central section 490. An enlarged disc-like formation 494 is provided at the one end of the central section 490. A hole 496 is formed through the disc-like formation 494. A hook-like formation 498 is provided at the other end of the central section 490. The hook-like formation 498 defines a U-shaped slot 500 into which the locking member 156 extends.

A pin 506 extends through the disconnect member hole 496 and into the bolt housing slot 382, as is best seen in FIG. 10. The pin 506 has a diameter which slip fits within the bolt housing slot 382 as the disconnect element 480 is translated in the passage 378 by movement of the locking member 456.

When the locking member 456 is in its unlocked position, as shown in FIGS. 9, 10 and 12, the locking member 456 positions the disconnect member 480 laterally with respect to the bolt passage 370 to a connecting position where, as is best seen in FIGS. 10 and 12, the abutment surface 492 is aligned with the path of travel of the handle operating arm 442 to provide a driving connection between the handle 430 and the bolt 390. When the disconnect member 480 is in its connecting position, pivotal movement of the handle 430 from its nested position, shown in FIGS. 8 and 9, to its operating position, shown in FIG. 12, will cause the disconnect member 480 to pivot about the axis of the pin 506, carrying with it the bolt 390, as shown in FIG. 12. Stated in another way, when the locking member 456 is in its unlocked position as shown in FIGS. 9 and 10, the central portion 490 of the disconnect member 480 is positioned such that it engages the bolt slot end 402 whereby a driving connection is established between the handle 430 and the bolt 390. Under these circumstances, movement of the handle 430 to its operating position will cause corresponding retracting movement of the bolt 390, as is illustrated in FIG. 12.

When the locking member 456 is in its locked position as shown in FIGS. 11 and 13, the disconnect member 480 is shifted laterally with respect to the bolt passage 370 to a position where, as is best seen in FIG. 11, the abutment surface 492 is positioned out of the path of travel of the operating arm 442, whereby no driving connection is provided between the disconnect member 480 and the bolt 390. When the disconnect member 480 is in its disconnecting position, pivotal movement of the handle 430 from its nested position to its operating position will cause the operating arm 442 to move into the U-shaped slot 500 and will cause no movement of the disconnect member 480, nor will it cause retracting movement of the bolt 390. Under these circumstances, the handle 430 can be moved freely without causing any corresponding movement of the bolt 390, as is illustrated in FIG. 12.

Referring to FIG. 11, the normal extended position of the bolt projection spring 410 is shown. When the handle 430 is extended to its operating position with the lock 320 "unlocked," the bolt projection spring 410 is correspondingly compressed. When, on the other hand, the handle 430 is extended with the lock 320 "locked," the bolt 390 remains in its projected position and the spring 410 remains in its extended attitude.

3. The Embodiment of FIGS. 14–24

Referring to FIGS. 14–24, a third embodiment of a key-controlled, paddle-handle, flush-mountable lock including features of the present invention is indicated generally by the numeral 620. The lock 620 is adapted to be supported on such structures as a swinging door (not shown) for relative movement therewith to bring the lock 620 into and out of juxtaposition with a cylindrical strike, indicated generally by the numeral 622. The strike 622 is typically supported on a door frame or other structure (not shown). The manner in which locks of this general type are mounted on doors is well known to those skilled in the art.

In general, the lock 620 includes a recessed body 630 having a latch bolt assembly 660 carried on the rear side of the body 630. A latch bolt 690 forms a part of the latch bolt assembly 660 and is movable between latched and unlatched positions. A control lever 700 forms a part of the latch bolt assembly 660 and is operable to release the latch bolt 690 for movement toward its unlatched position. A torsion coil spring 710 biases the bolt 690 toward its unlatched position. A paddle handle 730 is pivotally carried on the body 630 for movement between nested and operating positions. A key control 750 and a disconnect member 780 are provided for selectively drivingly connecting and disconnecting the handle 730 and the control lever 700. A tension coil spring 980 biases the disconnect member 780 toward a position of engagement with a guide member 950. A torsion coil 850 biases the handle 730 toward its normal nested position.

The body 630 is a rectangular, pan-shaped metal stamping having a perimetrically extending flange 632 which surrounds a forwardly facing recess 634. A back wall 636 defines the bottom of the recess 634. Forwardly extending end walls 642 and side walls 644 connect the back wall 636 with the flange 632.

Other features of the body 630 includes a stop formation 646 formed in the back wall 636. The stop 646 projects into the recess 634 and is engaged by the handle 630 when the handle 730 is in its nested position. A hole 650 is formed through the flange 632. Opposite sides of the hole 650 have flat, parallel-extending surfaces 652. Aligned holes 654 are formed through the side walls 644.

The latch bolt assembly 660 is of a commercially available type, sold by Eberhard Manufacturing Company, Cleveland, Ohio under the model designation 300R. In previously proposed installations, the latch bolt assembly 660 has normally been positioned at a location spaced from an operating handle and has been coupled to an operating handle by suitable rods or cables.

Referring to FIGS. 21–24, the latch bolt assembly 660 includes an L-shaped mounting plate 662 having a base leg 664 which lies along and is secured rigidly to the back wall 636 of the lock 620, and an orthogonally extending leg 666 which is notched, as indicated by the numeral 668, to receive the strike 622. A second L-Shaped mounting member 670 has a relatively short leg 672 welded to the base leg 664, and a relatively longer orthogonally extending leg 674 which parallels the leg 666 at a distance spaced therefrom. The leg 674 is notched, as indicated by the numeral 675, to receive the strike 622. The leg 674 is provided with a slot 676 through which the latch bolt trip lever 700 extends. The leg 666 is provided with a stop formation 677 which overlies the bolt 690. Mounting holes and/or slots 678 are provided in the legs 664, 672. Threaded fasteners 679 extend through selected ones of the holes and/or slots 678 to hold the latch bolt assembly 660 in place on the bottom wall 636 of the body 630.

Three sets of aligned holes 680, 682, 684 are formed through the parallel extending legs 666, 674. A jaw member 686 is carried between the legs 666, 674 in the vicinity of the first set of holes, 680. A rivet 688 extends through the first set of holes 680 and through the jaw member 686 to hold the jaw member 686 in place along one side of the aligned strike receiving slots 668, 675. The bolt member 690 is carried between the legs 666, 674 at a location adjacent the second set of holes 682. A rivet 692 extends through the second set of the holes 682 and through the bolt 690 to rotatably mount the bolt 690 between the legs 666, 674. A pawl member 694 is positioned between the legs 666, 674 adjacent the third set of holes 684. A rivet 696 extends through the third set of holes 684 and through the pawl member 694 to pivotally mount the pawl member 694 between the legs 666, 674.

Figure 19:
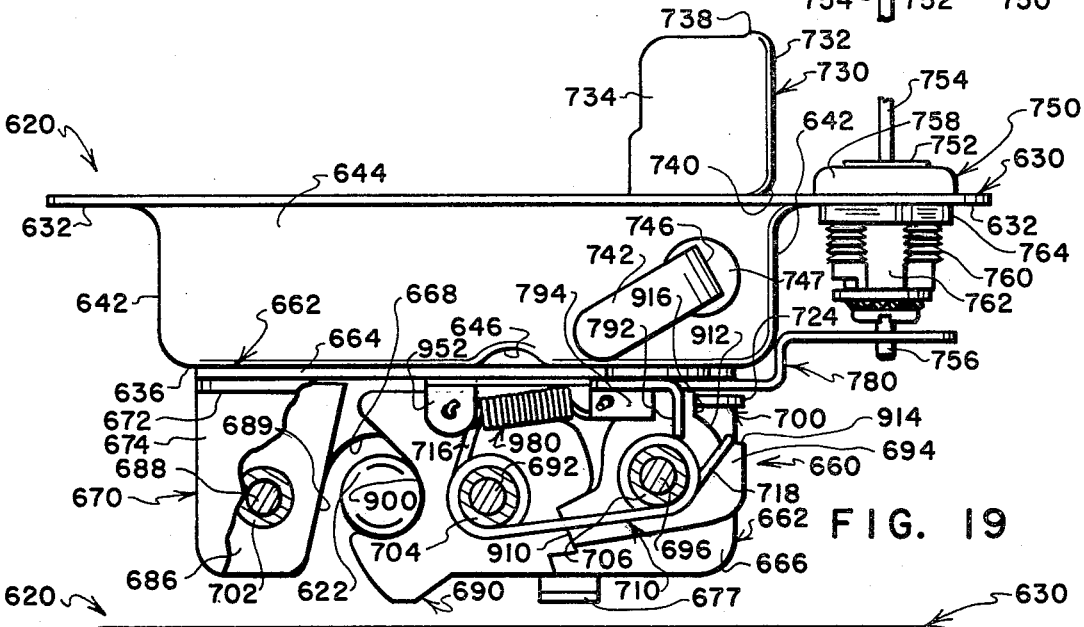
FIG. 19 is a bottom plan view similar to FIG. 16 with portions of the lock bolt assembly being broken away to permit underlying components to be viewed, with the components of the lock being positioned in a locked attitude, with the handle extended to an operating position, but with the lock bolt nonetheless latched.

As is best seen in FIG. 19 bushings 702, 704, 706 are mounted on the rivets 688, 692, 696 and extend between the leg 674 and the members 686, 690 694, respectively. The torsion spring 710 has coiled portions 712, 714 reeved around the bushings 704, 706 and end portions 716, 718 which engage the bolt and pawl members 690, 694. Referring to FIG. 19, the torsion coil spring 710 biases the bolt 690 in a counterclockwise direction and biases the pawl 694 in a clockwise direction.

The jaw member 686 is formed from hardened steel and provides an engagement surface 689 extending along one side of the leg slots 668, 675 to engage the strike 622. The jaw member 686 does not move relative to the mounting member legs 666, 674.

The latch bolt 690 has a U-shaped receiving slot 900 which is configured to receive the strike 622. The latch bolt 690 has a complexly configured perimeter which includes a notch formation 902 engaged by the spring end 716, and a first and second notches 904, 906 which are selectively engageable with the pawl member 694. The pawl member 694 has a projecting lug 910 which is selectively engageable with the notches 904, 906, and a notch 912 provided with end surfaces 914, 916. The spring end 718 engages the end surface 914. The end surface 916 is movable into and out of positions where it may be engaged by the control lever 700.

Figure 16:
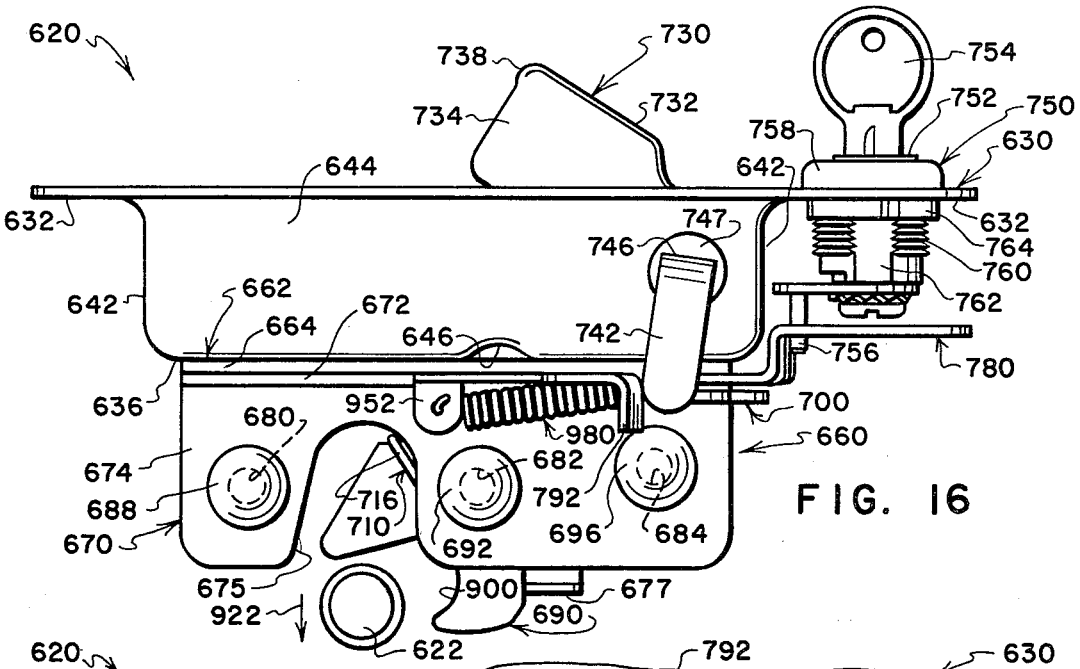
FIG. 16 is a bottom plan view of the lock of FIG. 14 with the components of the lock being positioned in an unlocked attitude, with the handle extended to an operating position and with the lock bolt unlatched to release a strike.
Figure 22:
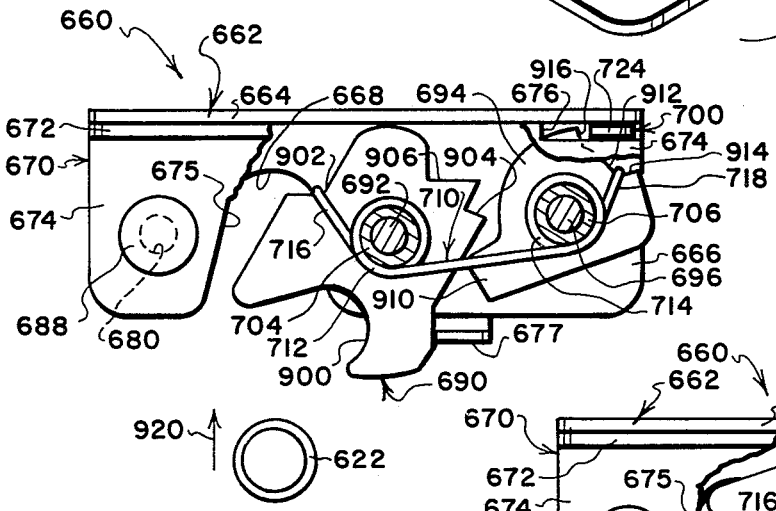
FIG. 22 is a bottom plan view similar to FIG. 16 showing the latch bolt assembly of the lock of FIG. 14 in an unlatched attitude about to engage a strike.

In FIGS. 16 and 22, the latch bolt 690 and the pawl 694 are shown positioned in their unlatching attitude. When unlatched, the bolt 690 is pivoted counterclockwise by the spring 710 to a position where the U-shaped receiving slot 900 opens downwardly to receive or discharge the strike 622. In this attitude, the pawl lug 910 engages neither of the bolt notches 904, 906.

Figure 23:
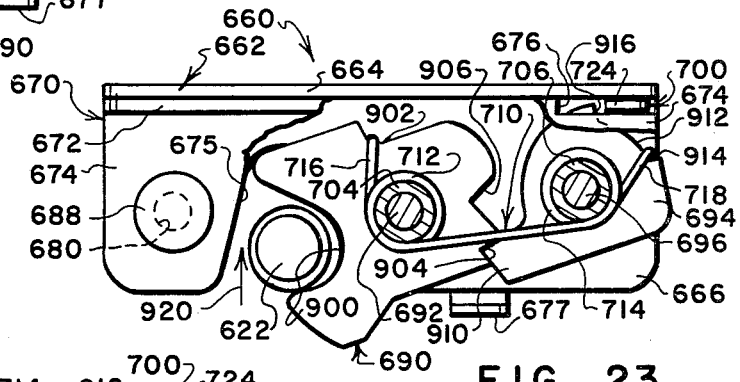
FIG. 23 is a bottom plan view similar to FIG. 22 with the strike in an initial retained position in the latch bolt assembly; and, FIG. 24 is a bottom plan view similar to FIGS. 22 and 23 with the strike received in latching engagement by the lock bolt assembly.

As the strike 622 moves into receiving engagement with the latch bolt receiving slot 900, as indicated by the arrows 920 in FIGS. 22 and 23, the strike 622 engages the U-shaped slot 900 and causes the latch bolt 690 to rotate clockwise in opposition to the action of the spring 710. As the bolt notch 904 approaches the pawl lug 910, the spring 710 causes the pawl 694 to rotate clockwise to a position where the lug 910 is received in the first latch bolt notch 904, as shown in FIG. 23. Once the lug 910 is received in the notch 904, the bolt 690 is prevented from rotating counterclockwise and the strike 622 is thereby retained in the leg notches 668, 675.

Figure 24:
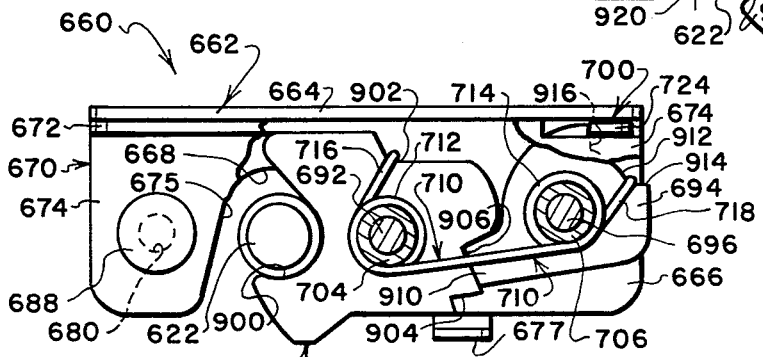

As the strike 622 moves further into receiving engagement with the latch bolt assembly 660, the strike 622 further rotates the latch bolt 690 clockwise in opposition to the action of the spring 710. As the bolt notch 906 approaches the pawl lug 910, the spring 710 causes the pawl 694 to rotate clockwise to a position where the lug 910 is received in the second latch bolt notch 906, as shown in FIG. 24. Once the lug 910 is received in the notch 906, the strike 622 is fully latched within the latch bolt assembly 660. The engagement of the pawl lug 910 with the bolt notch 906 prevents the strike 622 from rotating the latch bolt 690 out of its latching position.

In order to release the strike 622 from the latch bolt assembly 660, the control lever 700 is moved into engagement with the pawl end surface 916 and causes the pawl 694 to rotate counterclockwise in opposition to the spring 710. As the pawl 694 rotates counterclockwise, the lug 910 disengages the bolt 690, thereby permitting the bolt 690 to pivot to its unlatched position under the influence of the spring 710, whereupon the strike 622 is ejected from engagement with the latch bolt assembly 600 as is indicated by the arrow 922 in FIG. 16.

The control lever 700 is pivotally mounted on a pin 722 carried on the short leg 672 of the member 670. The control lever 700 has an end 724 which extends through the leg slot 676 to a position where it is engageable with end surface 916 formed on the pawl 694. The opposite end 726 of the lever 700 extends to a position where it is engageable by the disconnect member 680.

The paddle handle 730 is a sheet metal stamping having a generally rectangular, outer surface portion 732 and a pair of opposed, inwardly-turned side flanges 734. An inwardly-turned gripping flange 738 is provided at one end of the handle 730, and an inwardly-turned flange 740 is provided at the other end.

The handle 730 has aligned mounting holes 744 formed through its side flanges 734. A shaft 746 extends through the body holes 654 and through the handle mounting holes 744 to pivotally mount the handle 730 on the body 630 at a location between the body side walls 644. A pair of ferrules 747 formed from plastics material are carried in the body side holes 654 and serve to journal the shaft 746 in the holes 654. The shaft 746 is drivingly connected to the handle 730 for rotary movement as the handle 730 pivots. An operating arm 742 is carried on one end of the shaft 746 at a location behind the body flange 632. The handle return spring 850 drivingly engages one end of the shaft 746 and biases the handle 730 toward a nested position wherein the handle side flanges 734 engage bottom wall stops 646.

Figure 15:
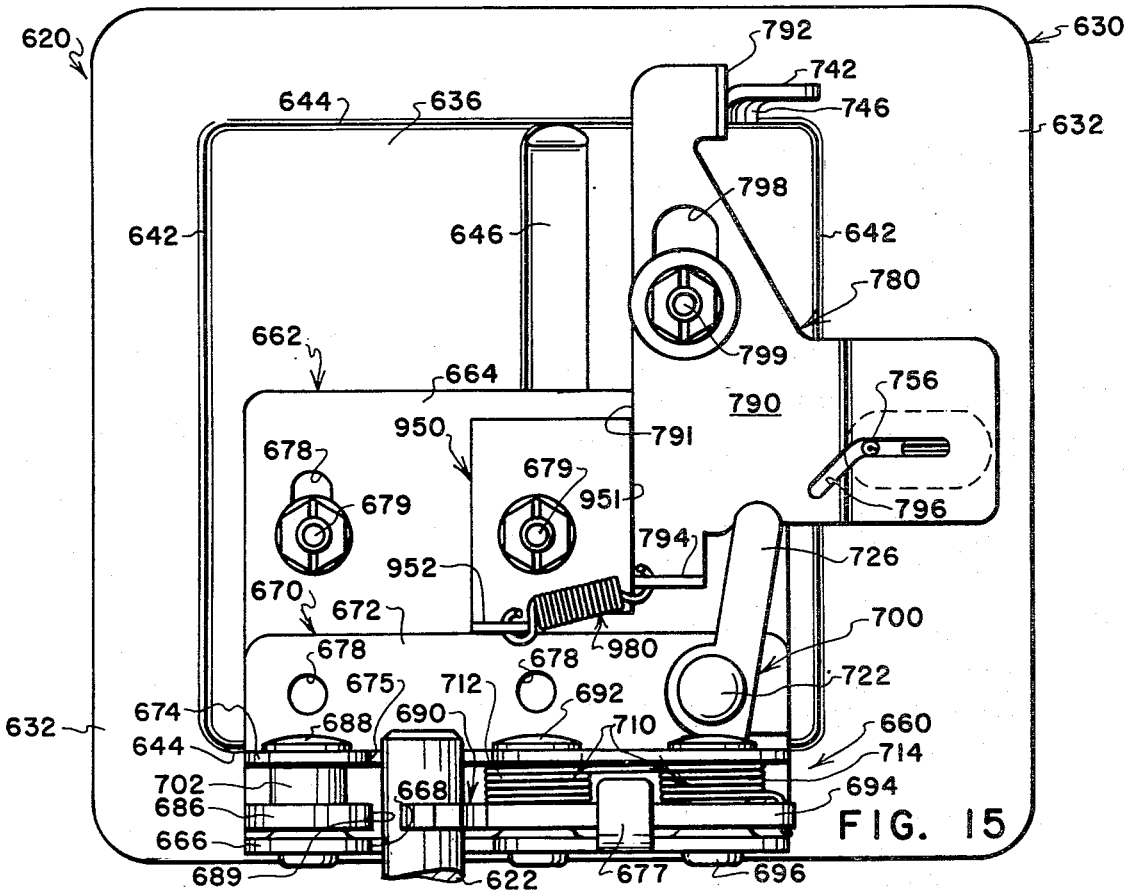
FIG. 15 is a rear side elevational view similar to the lock of FIG. 14 with the components of the lock being positioned as shown in FIG. 14.
Figure 17:
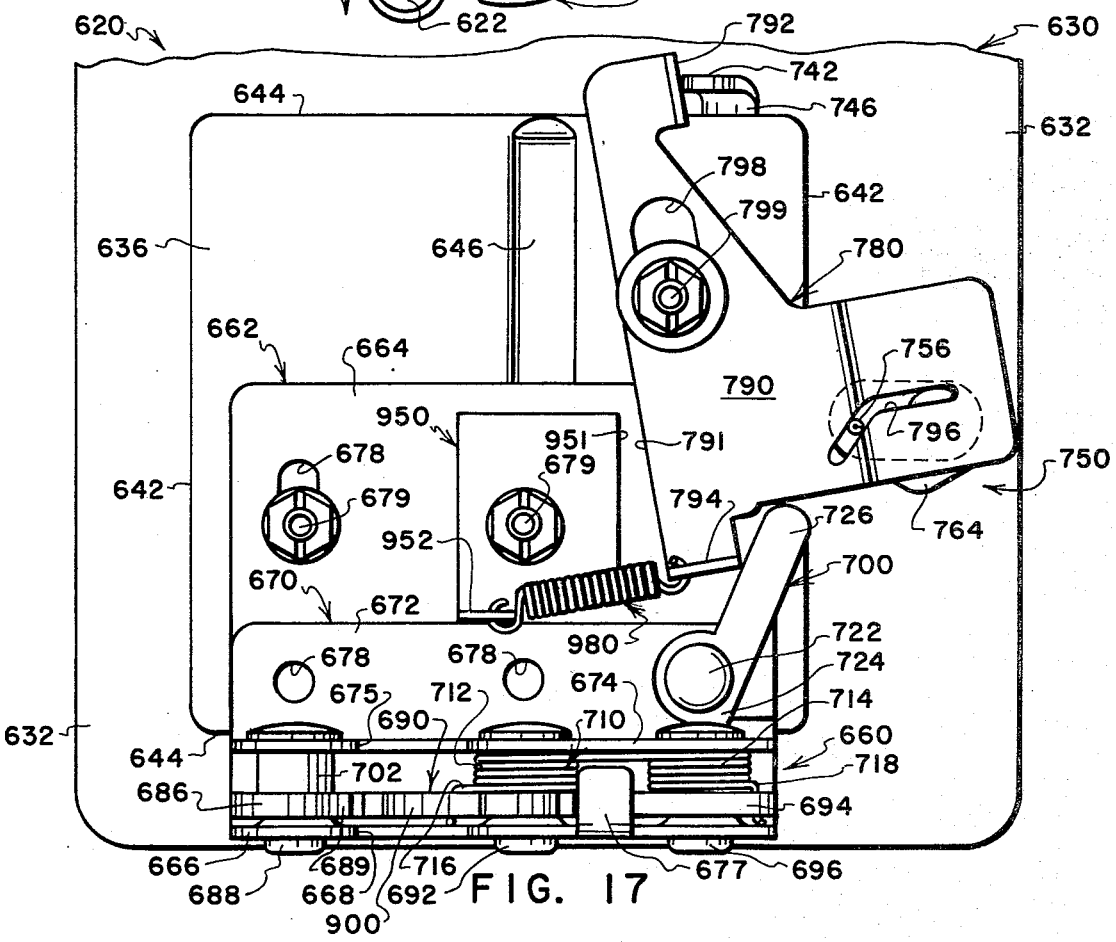
FIG. 17 is a rear side elevational view similar to FIG. 15 with the lock components positioned as shown in FIG. 16.
Figure 20:
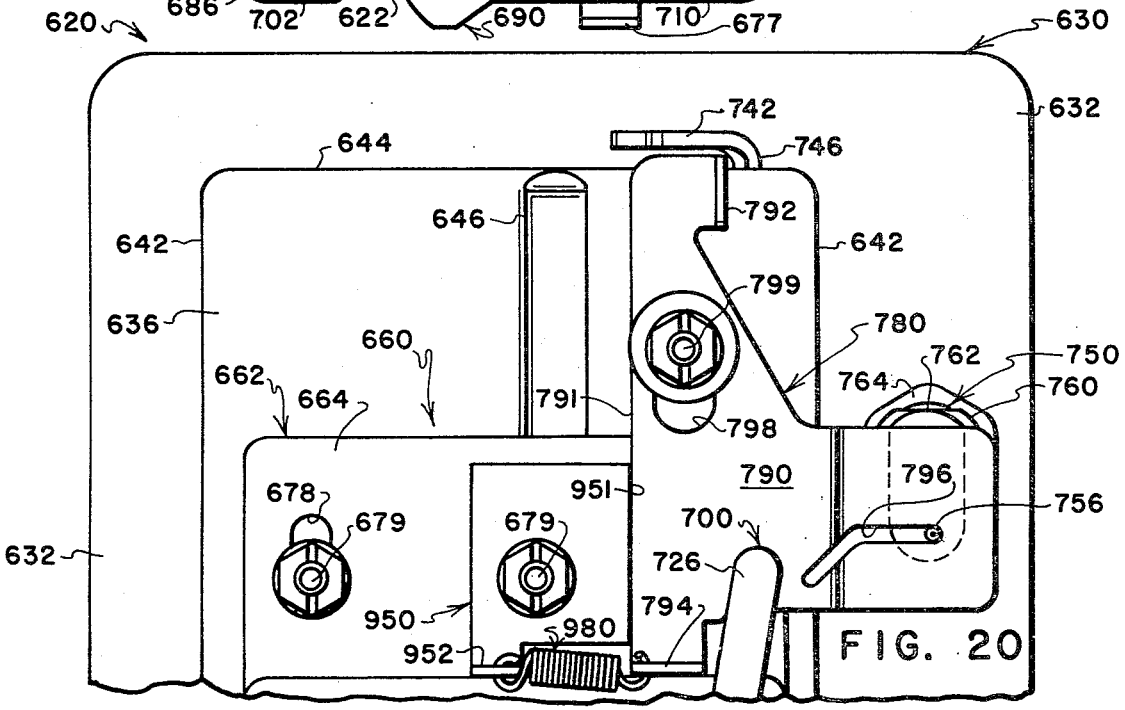
FIG. 20 is a rear side elevational view similar to FIGS. 15 and 17 but with the lock components positioned as shown in FIG. 19.
Figure 21:
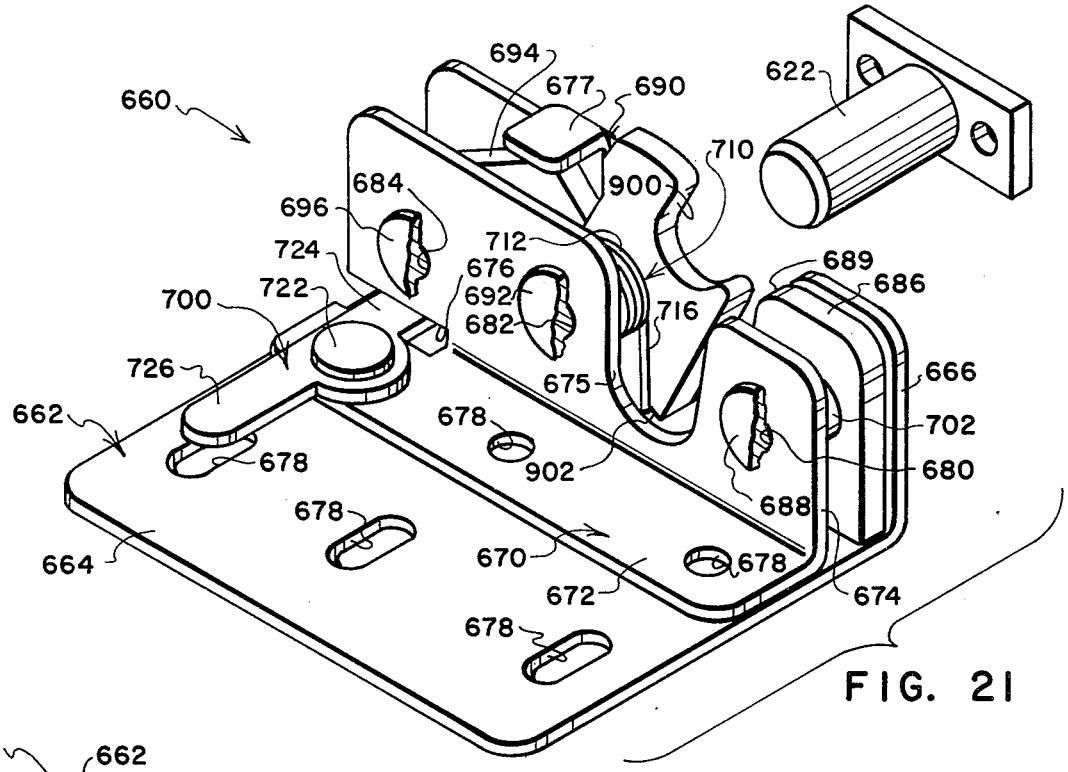
FIG. 21 is a perspective view of the latch bolt assembly employed in the lock of FIG. 14.

When the handle 730 is moved out of its nested position to an operating position by pivoting it about the axis of the shaft 746, as viewed in FIGS. 16 and 17, the disconnect member 780 is pivoted in opposition to the action of the spring 790, but only if the disconnect member 780 is positioned in what will be termed its "connecting" position. In FIGS. 15–17, the disconnect member 780 is in its connecting position wherein it provides a driving connection between the handle 730 and the latch bolt trip lever 700. When the disconnect member 780 is in its connecting position, the latch bolt trip lever 700 is caused to pivot, as viewed in FIGS. 16 and 17 when the handle 730 is moved to its operating position. In FIGS. 19 and 20, the disconnect member 780 is in its disconnecting position and provides no driving connection between the handle 730 and the latch bolt trip lever 700 whereby, when the handle 730 is pivoted about the axis of the shaft 746, no corresponding movement of the control lever 700 takes place.

The key control 750 includes a lock cylinder 752 into which a key 754 may be inserted. The key 754 is configured to cooperate with tumblers housed within the cylinder 752 to permit a locking member 756 to be rotated between locked and unlocked positions. The unlocked position of the locking member 756 is shown in FIGS. 14–17. The locked position of the locking member 756 is shown in FIGS. 19 and 20.

The cylinder 752 is provided with an enlarged head 758 and a threaded body 760. A pair of flats 762 are formed on opposite sides of the threaded body 760. The cylinder 752 is positioned with its head 758 engaging the forward surface of the body flange 632, with its body 760 extending through the hole 650, and with its flats 762 engaging the flat surfaces 652. A locknut 764 is threaded onto the body 760 to hold the cylinder 752 in place on the lock body 630.

While the key control 750 is of a conventional, commercially available type, it is selected from among various commercially available key controls which have particular operational characteristics. These operational characteristics should include key removal capability when the locking member 756 is positioned in either of its locked and unlocked positions. A further characteristic of the key control 750 is that, once the locking member 756 has been positioned in either of its locked or unlocked positions and the key 754 has been removed from the cylinder 752, the key control 750 maintains the locking member 756 in such position.

Referring to FIGS. 15 and 17, the disconnect member 780 has an elongate, flat central section 790 bordered along one side by a straight edge surface 791. A rounded abutment surface 792 is defined near one end of the central section 790. The rounded tab formation 794 is provided at the other end of the central section 790. A curved slot 796 is formed through the central section 790. The locking member 756 extends into the slot 796. A straight slot 798 is also formed in the central section 790. A threaded fastener 799 extends through the slot 798 and serves to restrain the freedom of movement of the disconnect member 780 relative to the body 630.

The guide member 950 is carried on the base leg 664 and is held in place by one of the threaded fasteners 679. The guide member 950 has a straight edge surface 951 which is configured to engage the disconnect member edge surface 791 when the disconnect member 780 is positioned as shown in FIGS. 15 and 20. The guide member 950 carries a rearwardly turned tab 952. Opposite ends of the tension coil spring 980 engage the tabs 952, 794 whereby the spring 790 biases the disconnect member 780 toward a position where its edge surface 791 engages the guide member edge surface 951.

When the locking member 756 is in its unlocked position as shown in FIGS. 15–17, the locking member 756 positions the disconnect member 780 in what will be termed its "connecting" position where, as is best seen in FIG. 15, the abutment surface 792 is positioned within the path of travel of the handle operating arm 742, and thereby provides a driving connection between the handle 730 and the control lever 700. When the disconnect member 780 is in its connecting position, pivotal movement of the handle 730 from its nested position, shown in FIG. 14, to its operating position, shown in FIG. 16, will cause the disconnect member 780 to pivot, carrying with it the latch bolt trip lever, 700 as shown in FIG. 17. Stated in another way, when the locking member 756 is in its unlocked position, the disconnect member 780 is positioned such that a driving connection is established between the handle 730 and the control lever 700. Under these circumstances, movement of the handle 730 to its operating position will cause corresponding unlatching movement of the control lever 700, as is illustrated in FIG. 17.

Figure 18:
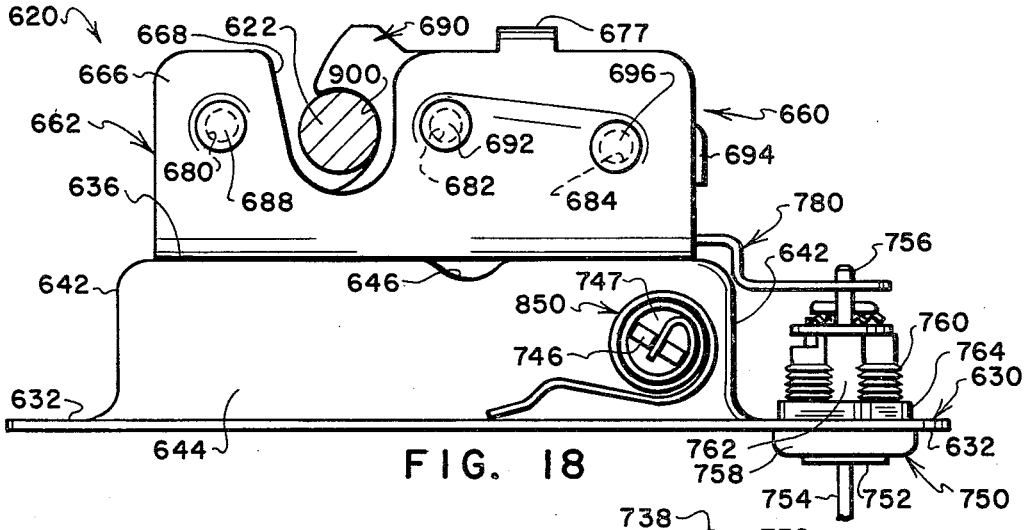
FIG. 18 is a top plan view of the lock of FIG. 14 with the components of the lock being positioned in a locked attitude, with the handle nested and with the lock bolt in latching engagement with a strike.

When the locking member 756 is in its locked position as shown in FIGS. 18–20, the disconnect member 780 is shifted laterally to what will be called its "disconnecting" position where, as is best seen in FIG. 20, the abutment surface 792 is positioned out of the path of travel of the operating arm 742, and no driving connection is provided between the disconnect member 780 and the control lever 700. When the disconnect 780 is in its disconnecting position, pivotal movement of the handle 730 from its nested position to its operating position will cause no movement of the disconnect member 780, nor will it cause unlatching movement of the control lever 700. Under these circumstances, the handle 730 can be moved freely without causing any corresponding movement of the control lever 700, as is illustrated in FIGS. 19 and 20.

4. Conclusion

As will be apparent from the foregoing description, a feature of the present invention lies in the provision of door locks which are particularly well suited for use on pivoted closures. Locks embodying the preferred practice of the present invention feature flexibility of installation and reliability of operation. The locks are formed from simple and inexpensive-to-manufacture components, and are of sturdy construction.

A feature of locks embodying the present invention is that their operating handles are free to move at all times, but are only operable to release their latch bolts when their key controls are positioned in "unlocked" attitudes. The described lock embodiments have "slam" capabilities enabling their latch bolts to be moved into latching engagement with suitably configured strikes regardless of whether the locks are "locked" or "unlocked." Moreover, if the latch bolts of these locks are slammed into engagement with suitably configured strikes, the latch bolts will move to latchingly engage the strikes without causing corresponding movement of the lock handles.

Locks of the first of the three described types are preferably employed where there are mounting restrictions that require the provision of flush-mountable locks of substantially conventional configuration. Locks of the second described type are preferably utilized where slightly expensive, non-conventionally configured locks can be employed. Locks of the third described type are preferably utilized in installations where there are needs not only for a "slam" capability but also for a capability to prevent the strike from moving the latch bolt out of its latching position. Moreover, locks of the third described type are well suited for use where "racking" movements of a pivoted closure and its surrounding framework are likely to be encountered, and where more conventionally configured locks might be ineffective in achieving a secure locking action.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A door lock, comprising:

(a) a body structure, including:

(i) a generally pan-shaped body having a back wall and a side wall extending forwardly therefrom, the back wall and the side wall cooperating to define a forwardly-facing recess, the side wall including opposed, substantially parallel-extending side wall portions on opposite sides of the recess, and a front wall connected to the side wall and extending perimetrically about the side wall to define a substantially planar mounting flange which defines the perimeter of the body;

(ii) plate means connected to the back wall of the body and cooperating therewith to define a slide bolt passage and a disconnect member passage which intersect at a central location along the back wall, the slide bolt passage extending in a direction substantially paralleling the side wall portions, the disconnect member passage extending in a direction transverse to the direction of the slide bolt passage, the plate means having an elongate slot formed therethrough opening into the disconnect member passage near one end thereof and extending in a longitudinal direction substantially paralleling the direction of the disconnect member passage;

(b) an elongate slide bolt positioned in the slide bolt passage and being slidably carried therein for movement along a first path of travel between a latching position wherein the slide bolt is relatively extended with respect to the body structure, and an unlatching position wherein the slide bolt is relatively withdrawn with respect to the body structure, the slide bolt having a connecting formation provided thereon at a location near where the slide bolt extends across the disconnect member passage;

(c) a nestable handle structure, and shaft means for pivotally mounting the handle structure on the body structure for forward and rearward movement relative to the body structure between a normal position wherein the handle structure is relatively nested within the body recess, and an operating position wherein the handle structure is relatively extended with respect to the body recess, the shaft means extending in a direction substantially paralleling the direction of the disconnect member passage and having an end portion which extends through a hole formed in at least one of the opposed side wall portions of the pan-shaped body, an operating formation connected to the shaft means end portion and projecting rearwardly with respect to the front wall of the pan-shaped body, the operating formation and the handle structure being drivingly connected such that the operating formation moves along a second path of travel relative to the body structure as the handle structure is moved between its normal and operating positions, the second path of travel being defined to lie within a plane which substantially parallels the direction of the first travel path;

(d) key-control means connected to the body structure and having a locking member which is movable relative to the body structure between locked and unlocked positions, the key-control means being operable to selectively retain the locking member in its locked and unlocked positions;

(e) an elongate disconnect member positioned in the disconnect member passage and being slidably carried therein for movement along a third path of travel extending longitudinally of the disconnect member passage, the disconnect member having one end which projects beyond the disconnect member passage and carries an abutment surface, the disconnect member being movable along the third travel path between a connecting position wherein the abutment surface intersects the second path of travel of the operating formation, and a disconnecting position wherein the abutment surface is withdrawn from the second travel path;

(f) pin means extending through the elongate slot formed in the plate means and connecting with the other end portion of the disconnect member for cooperating with the ends of the elongate slot to limit the range of sliding movement of the disconnect member along the third travel path, and for pivotally connecting the disconnect member and the plate means to enable the disconnect member to pivot relative to the body structure along a fourth path of travel which has the form of an arc with its center of radius being the locus of the pin means, the arc of the fourth travel path extending substantially parallel to the directions of the first and second travel paths;

(g) connecting means for:

(i) moving the disconnect member from its disconnecting position to its connecting position in response to movement of the locking member from its locked position to its unlocked position, whereby the abutment surface of the disconnect member is brought into the second travel path during such movement of the locking member to drivingly couple the operating formation and the disconnect member; and, (ii) moving the disconnect member from its connecting position to its disconnecting position in response to movement of the locking member from its unlocked position to its locked position, whereby the abutment surface is withdrawn from the second travel path thereby preventing the operating formation from drivingly engaging the disconnect member when the operating formation moves along the second travel path; and, (h) the disconnect member means being engageable with the connecting formation on the slide bolt to move the slide bolt from its latching position to its unlatching position when the disconnect member is moved along the fourth travel path in response to movement of the operating formation along the second travel path during movement of the handle structure from its normal position to its operating position.

2. The flush-mountable door lock of claim 1 wherein the connecting means includes linkage means movably supported on the body structure for drivingly interconnecting the disconnect member and the locking member.

3. The door lock of claim 2 wherein the linkage means includes an elongate lever pivotally connected to the body structure at a location between opposite end regions of the lever.

4. The door lock of claim 3 wherein one end region of the lever has a hole formed therethrough to receive at least a portion of the locking member.

5. The door lock of claim 3 wherein one end region of the lever is connected to the pin means to effect a driving connection between the disconnect member and the linkage means.

6. The door lock of claim 5 wherein the one end region of the lever connects with the pin means on the opposite side of the plate means from the side of the plate means which cooperates with the back wall to define the disconnect member passage.

7. The door lock of claim 1 wherein the connecting means includes a formation connected to the disconnect member, which formation is engaged directly by at least a part of the locking member to drivingly connect the disconnect member and the locking member.

8. The door lock of claim 7 wherein the disconnect member formation includes a slot which is caused to be brought into and out of alignment with the second travel path in response to movement of the locking member into its locked and unlocked positions, respectively.

9. The door lock of claim 1 wherein the disconnect member is a generally planar plate-like member, and the abutment surface is a rounded surface provided on a projection of the plate-like member which is bent out of the plane of the plate-like member.

10. The door lock of claim 1 wherein means establishing a lost motion connection connects the disconnect member and the bolt structure for enabling the bolt structure to be moved from its latching position to its unlatching position without causing corresponding movement of the disconnect means.

11. The door lock of claim 1 additionally including biasing means interposed between the body structure and the slide bolt for biasing the slide bolt toward a selected one of its latching and unlatching positions.

12. The door lock of claim 1 wherein the locking member is rotatably mounted for movement between its locking and unlocking positions.

13. The door lock of claim 1 wherein the shaft means and the operating formation are formed as a one-piece L-shaped part, the shaft means comprising one leg of the L-shaped part and being journaled by aligned holes formed in the opposed side wall portions, the operating formation comprising the other leg of the L-shaped part.

* * * * *